US008011096B2

(12) United States Patent
Reeb et al.

(10) Patent No.: US 8,011,096 B2
(45) Date of Patent: Sep. 6, 2011

(54) METHODS FOR INCREASING THE FATIGUE LIFE, OF CRANKSHAFTS

(75) Inventors: Alfons Reeb, Aalen (DE); Jochen Schmidt, Schwaebisch Gmuend (DE); Alexis Boemcke, Dortmund (DE)

(73) Assignee: Maschinenfabrik Alfing Kessler GmbH, Aalen (DE)

( * ) Notice: Subject to any disclaimer, the term of this patent is extended or adjusted under 35 U.S.C. 154(b) by 1254 days.

(21) Appl. No.: 10/588,566

(22) PCT Filed: Feb. 5, 2005

(86) PCT No.: PCT/EP2005/001190

§ 371 (c)(1),
(2), (4) Date: Jan. 31, 2007

(87) PCT Pub. No.: WO2005/090617

PCT Pub. Date: Sep. 29, 2005

(65) Prior Publication Data

US 2007/0169532 A1 Jul. 26, 2007

(30) Foreign Application Priority Data

Feb. 23, 2004 (DE) ..... 10 2004 008 728

(51) Int. Cl.
*B23P 17/00* (2006.01)

(52) U.S. Cl. ..... 29/888.08; 29/446; 72/460

(58) Field of Classification Search ..... 29/888.08, 29/446; 72/460

See application file for complete search history.

(56) References Cited

U.S. PATENT DOCUMENTS 2,888,846 A 6/1959 Peras ..... 78/13
4,682,489 A * 7/1987 Bauerle et al. ..... 72/460

FOREIGN PATENT DOCUMENTS

JP 58130796 7/1983

* cited by examiner

*Primary Examiner* — Derris H Banks
*Assistant Examiner* — Azm Parvez
(74) *Attorney, Agent, or Firm* — Wells St. John P.S.

(57) ABSTRACT

The invention relates to a method for increasing the bending strength and the endurance limit of crankshafts by locally restricted hammering in areas of high stress, such as grooves, the mouths of bores and cross-sectional transition zones, in which method pressure impulse machines or beating devices comprising heating tools are employed. The pressure impulse machines or beating devices only execute a relative displacement of the beating tool against the surface of the crankshaft segment to be processed when the compressive stress is introduced between the heating tool and said surface of the crankshaft segment to be processed. The invention also relates to a device for increasing the endurance limit of crankshafts.

19 Claims, 4 Drawing Sheets

METHODS FOR INCREASING THE FATIGUE LIFE, OF CRANKSHAFTS

CROSS REFERENCE TO RELATED APPLICATION

This is a 35 U.S.C. §371 application of and claims priority to PCT International Application Number PCT/EP2005/001190, which was filed Feb. 5, 2005, and was published in German, and which was based on German Patent Application No. 10 2004 008 728.8, filed Feb. 23, 2004, and the teachings of all the applications are incorporated herein by reference.

FIELD OF THE INVENTION

The invention relates to a method for increasing the fatigue life, in particular the bending fatigue life and the torsional fatigue life of crankshafts, in particular of large crankshafts, by local hammering of highly loaded areas, such as grooves, hole mouths and cross-sectional junctions, by means of pulsed-pressure machines or striking apparatuses which introduce intrinsic compressive stresses into the crankshaft via striking tools. The invention also relates to an apparatus for increasing the fatigue life of crankshafts.

DESCRIPTION OF THE RELATED ART

A method and an apparatus of this type are described in DE 34 38 742 C2.

SUMMARY OF THE INVENTION

In order to avoid disadvantageous introduction of tangential stresses during local hammering, it has been proposed in this case that no relative movement be allowed to take place transversely with respect to the impulse direction at the time during which the pulsed-pressure is acting between the body emitting the impulse and the workpiece surface. For this purpose, feeding should take place in steps while the intrinsic compressive stresses are being introduced by the striking tools.

The present invention is based on the object of further improving the method mentioned initially, in particular with regard to effectiveness and increasing the fatigue life, in particular the bending fatigue life and the torsional fatigue life.

According to the invention, this object is achieved in that the pulsed-pressure apparatuses or striking machines carry out only a relative movement on a plane at right angles to the surface of the crankshaft segment at the time at which the compressive stress is introduced between the striking tool and the crankshaft segment to be processed.

In the case of the method according to the invention, as in the case of the prior art, tangential stresses are largely avoided, if not even completely avoided. This is the case in particular when the crankshaft is rotated continuously during the processing, with the rotational movement of the crankshaft while the intrinsic compressive stresses are being introduced by the striking tool striking the crankshaft segment to be processed being stopped for the time during which the striking tool is acting on the crankshaft.

In order to achieve this, it is possible to provide in one highly advantageous refinement of the invention for the time during which the striking tool is acting and the striking pressures to be chosen such that the rotational movement of the crankshaft is necessarily stopped.

In contrast to the prior art, the method can in this way be carried out with a continuous drive for the crankshaft, thus making it possible to design the apparatus according to the invention in a appropriately simple manner.

All that is necessary for this purpose is to choose the striking frequency and the striking pressures or striking forces such that the rotary drive for the crankshaft and the parts which are associated with it, such as transmissions, produce the applied "positive stops" without damage.

In practice, the entire drive system is stressed like a spring by the "positive stops", which spring is then unloaded again, and the rotational movement is correspondingly used again for the crankshaft.

In practice, advantageous striking frequencies have been found to be between 0.1 and 20 Hz, preferably between 1 and 10 Hz, and even more preferably between 3 and 6 Hz. Depending on the operation, the striking pressures should be between 10 and 300 bar, preferably between 30 and 130 bar, and even more preferably between 50 and 120 bar.

The values mentioned above allow the method according to the invention to be carried out optimally in practice.

The temperature in the region of the crankshaft segment to be processed should not be more than 65° C.; values between 12 and 25° C. are preferred.

The method according to the invention can also be used for crankshafts which have already previously been processed by means of other methods for increasing their fatigue-life characteristics. For example, it is thus also possible, for example, for a crankshaft which has already been processed by induction hardening to retrospectively also be improved in terms of its bending fatigue life and fatigue life by the introduction of intrinsic compressive stresses using the method according to the invention.

In practice, it has been found that, by the introduction of intrinsic compressive stresses via the striking tool, which in general has a spherical shape, it is also possible even for surface cracks to be formed without loading, because of material mounds. In general, these cracks do not propagate any further and are also not serious in terms of the fatigue-life characteristics, although, at least, they disturb the visual impression. In one refinement of the invention, it is therefore possible to provide for the intrinsic compressive stresses close to the surface once the intrinsic compressive stresses have been introduced by the striking tools to be reduced by machining away the surface of the crankshaft segment to be processed, and for the deformation cracks on the surface to be removed.

Since the intrinsic compressive stresses can be introduced to a depth of 15 mm or even more, this means that a few millimeters of material in the surface area can be removed, for example from 0.3 to 2 mm, preferably 0.5 mm, without any disadvantageous effect on the bending fatigue life or the fatigue life or the crankshaft.

The surface can be removed in various ways, for example by grinding, turning or milling.

Particularly in the case of large crankshafts, a so-called catenary shape is frequently chosen for groove radii. A very large junction radius is frequently desirable in order to keep the load stress relatively low, while on the other hand a relatively small radius is desirable at the junction to the running surface, in order to obtain a running surface which is as broad as possible.

However, in the past there have been problems in practice in introducing intrinsic compressive stresses into a catenary shape in a technically worthwhile manner.

In order to solve this problem, one development of the invention now proposes that in one refinement of the crankshaft segment to be processed, and which is in the form of a catenary, the continuous junction radii which are in the form of an initial contour are compressed by the introduction of the intrinsic compressive stresses via the striking tools, and the junction radii are then processed to the required final contour, as a catenary shape, by a method for removing material from the surface.

This means that an initial contour is provided, with a continuous junction radius which corresponds to the large junction radius. This radius is compressed by the impact strengthening with the striking tool, and the junction radii are then processed to the required final contour, in the form of a catenary, with a correspondingly large junction radius and a considerably smaller radius at the junction to the running surface.

This processing can be carried out in the same way as the surface processing in order to overcome or avoid cracks, for example by grinding, turning or milling.

As an alternative to this, it is possible to provide that, in one refinement of the crankshaft segment to be processed to and in the form of a catenary shape, the catenary shape of a striking tool is formed on a plane which extends in the longitudinal direction of the crankshaft, while, for example, a spherical shape is formed on a plane at right angles to the longitudinal direction.

A striking tool such as this which thus no longer has the normal spherical shape in the striking area allows the contour shape to be compressed in one process, and thus to be produced without further machining.

Instead of two striking tools per striking machine, it is also possible to provide for the pulsed-pressure apparatuses or striking machines each to be aligned with their longitudinal axes in the striking direction, and for the intrinsic compressive stresses to be introduced by in each case only one striking tool, which is arranged in the associated pulsed-pressure apparatus or striking machine.

This refinement results in a line contact with the crankshaft segment to be processed remaining for all striking areas.

The method according to the invention can be used not only to increase the bending fatigue life and the fatigue life of crankshafts but in an advantageous manner also for the adjustment of elongated components, in particular of crankshafts. During this process, intrinsic compressive stresses are introduced in a locally limited form by the method according to the invention using the striking tools, in order to make a correspondingly curved crankshaft straight. For this purpose, the striking tools need be arranged only at the appropriate points. In contrast to the known adjustment methods, this method according to the invention has no negative effects on the fatigue life. In contrast, one side effect of the method according to the invention is that there is even a positive influence on the fatigue life of the crankshaft or of the elongated component.

Although the method according to the invention has been described for the processing of crankshafts, it is in principle also suitable for other elongated components, such as compressor shafts, eccentric shafts or cross-link shafts. In principle, the invention relates to all components which are subject to particular dynamic loads.

BRIEF DESCRIPTION OF THE DRAWINGS

Exemplary embodiments of the invention will be described in principle in the following text with reference to the drawing, in which.

DETAILED DESCRIPTION

Figure 1:
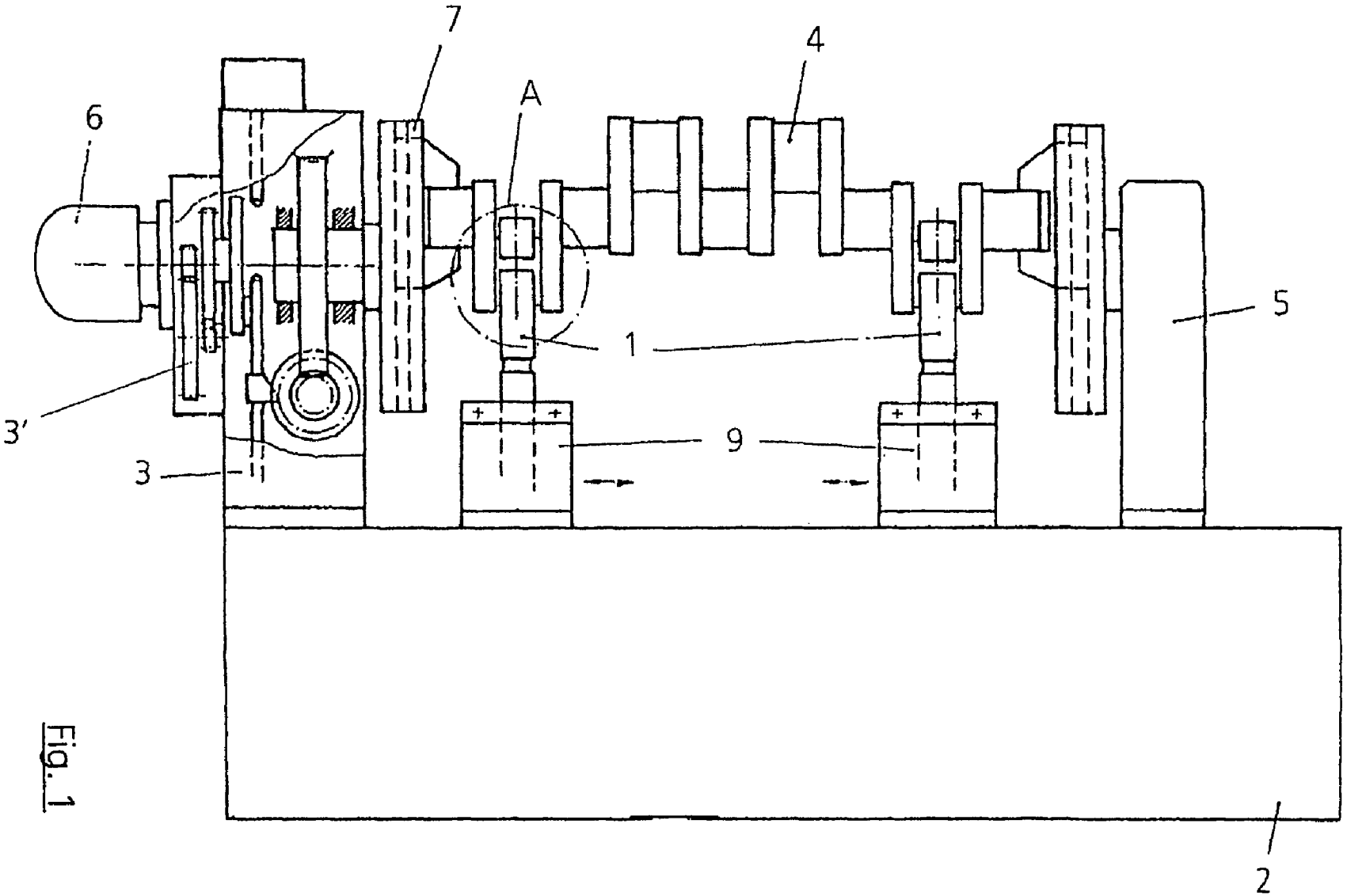
FIG. 1 shows an overall view of an apparatus for carrying out the method.

In principle, the design of the apparatus of which an overall view is illustrated in FIG. 1, corresponds to that of the apparatus according to DE 34 38 742 C2 with a plurality of pulsed-pressure machines 1, for which reason only the major parts and the differences from the prior art will be described in more detail in the following text.

The apparatus has a machine bed 2 and a gearbox 3 with a transmission 3', in order to cause a workpiece, specifically a crankshaft 4, to rotate. The crankshaft 4 is held in a support 5 such that it can rotate, at the end remote from the gearbox 3 and the transmission 3'.

A drive 6 ensures continuous rotational movement of the crankshaft 4, which is held in a chuck 7, via the transmission 3'.

The pulsed-pressure machines 1 (two are illustrated in the drawing) described in the following text are each held adjustably in a movement and adjusting device 9 in order to match them to the position and the length of the crankshaft 4.

Figure 2:
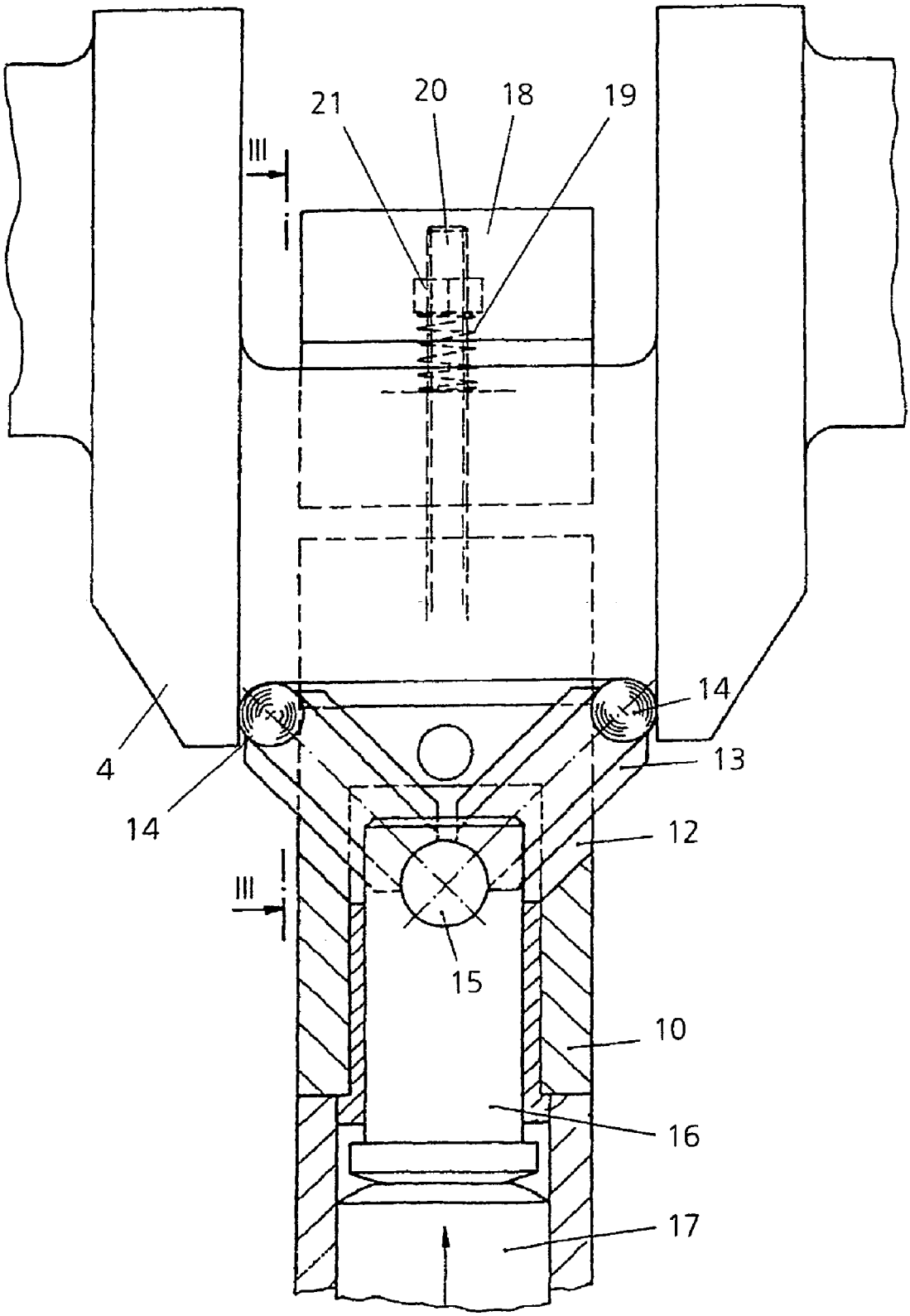
FIG. 2 shows a pulsed-pressure machine, illustrated enlarged, based on the detail "A" from FIG. 1.
Figure 3:
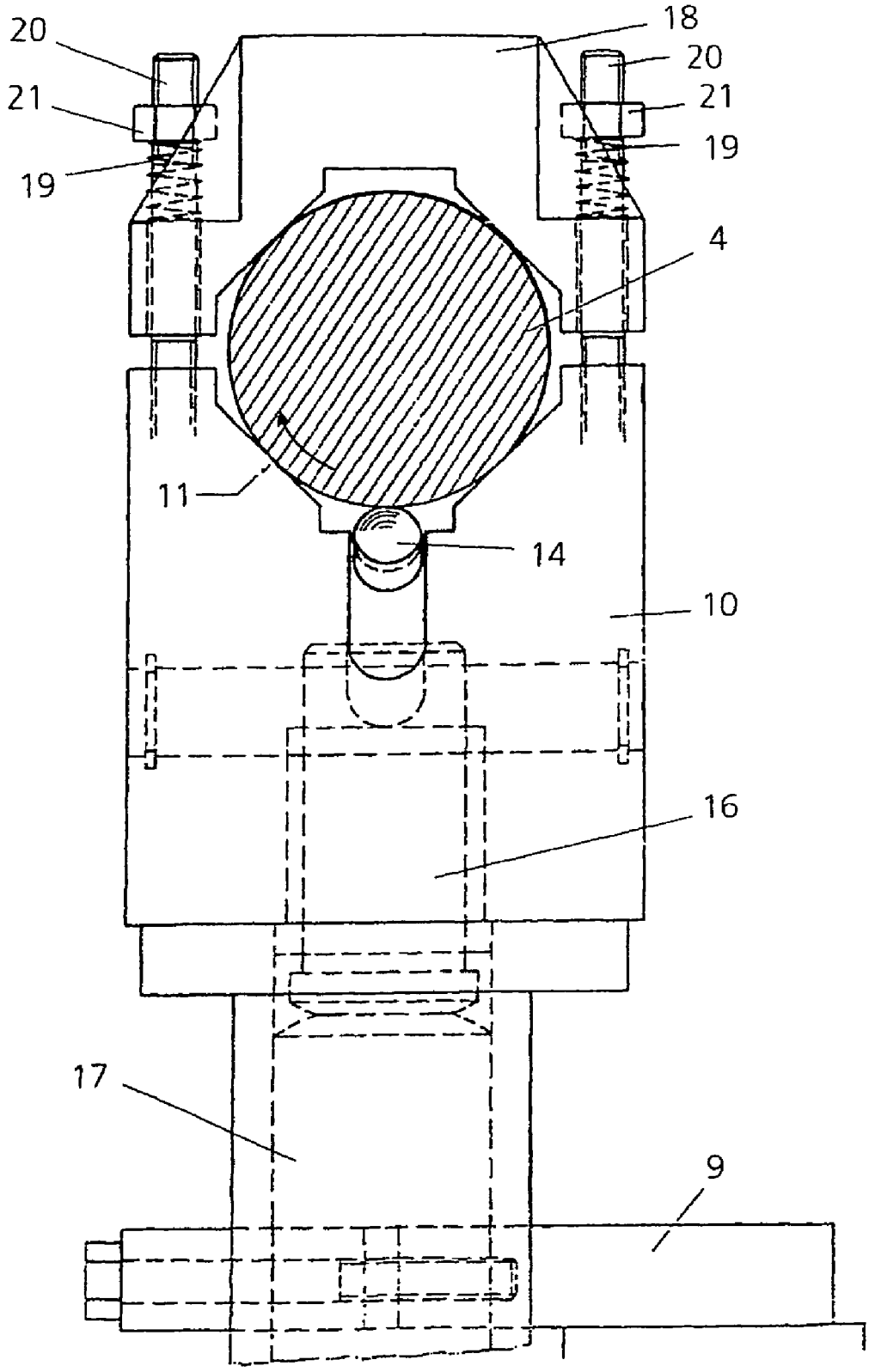
FIG. 3 shows a section III-III through the crankshaft in order to illustrate the pulsed-pressure machine shown in FIG. 2, in the axial direction.

The design of a pulsed-pressure machine 1 is illustrated in more detail in FIG. 2. This machine has a base body 10 which is provided with a prismatic contact 11 corresponding to the radius of the crankshaft segment to be processed, and has guides 12 in it, which carry two anvils 13 on their supporting plane and give them corresponding freedom about a bolt 15 in the supporting angle, as are required for matching to the dimensional relationships of the crankshaft 4. A sphere is arranged at the front ends of each of the two anvils 13, as a striking tool 14. An intermediate part 16 provides the connection between a striking piston 17 and a bolt 15, which passes the impact energy to the anvils 13.

In order to increase the effectiveness of the impact, a stressing prism 18 can be mounted on the opposite face of the base body 10 via springs 19, with adjustable tightening bolts 20 and tightening nuts 21.

If required, all of the areas which run centrally, and if appropriate eccentrically, can be processed at the same time by arranging a plurality of pulsed-pressure machines 1 over the length of the crankshaft 4 to be processed.

The drive 6 and the transmission 3' are designed such that they produce a continuous rotational movement of the crankshaft 4. However, as soon as the striking tools 14 strike the crankshaft 4, the rotational movement is positively interrupted, and the crankshaft 4 is stopped because of the high impact strength during the period of the impact of the striking tools 14. This admittedly results in stress being built up in the transmission 3', but this does not lead to any damage because of a special transmission coupling in the interaction process, and specially matched transmission play. The work is preferably carried out at a striking frequency of 3 to 6 Hz and with pressure forces of 50 to 120 bar.

In order to prevent or avoid cracks, the crankshaft 4 can also have material removed from the processed crankshaft segments if required, using a grinding, milling or turning tool, to a depth of 1.5 mm.

Figure 4:
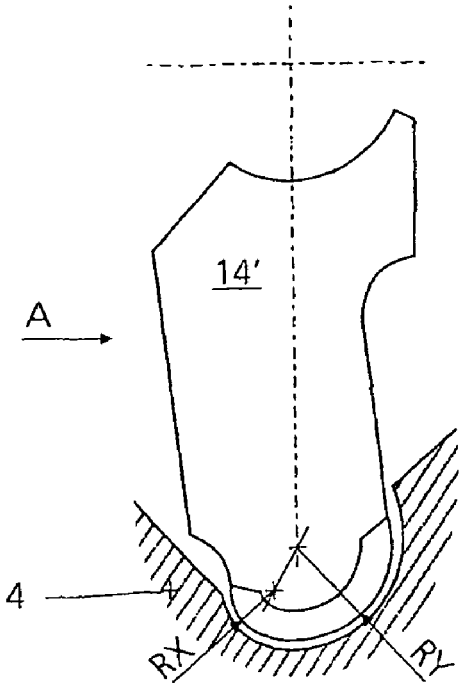
FIG. 4 shows a side view of a striking tool with a catenary shape.
Figure 5:
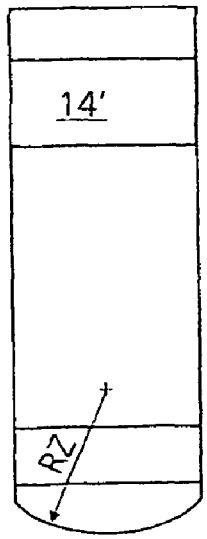
FIG. 5 shows a view of the striking tool in the axial direction (direction of the arrow A in FIG. 4)

FIGS. 4 and 5 show a striking tool 14' which is in the form of a catenary in order to strengthen radii junctions in the catenary shape. As can be seen, the striking tool 14' has two different radii in the longitudinal direction of the crankshaft 4, specifically a larger radius Ry which, for example, has a radius of 17 mm, and a smaller radius Rx with, for example, a radius of 8 mm. The smaller radius Rx represents the junction radius to a running surface. As can be seen from FIG. 5, the striking tool 14' has a spherical radius Rz in a direction at right angles to the direction of the catenary shape of the striking tool 14, that is to say transversely with respect to the longitudinal axis of the crankshaft 4.

Figure 6:
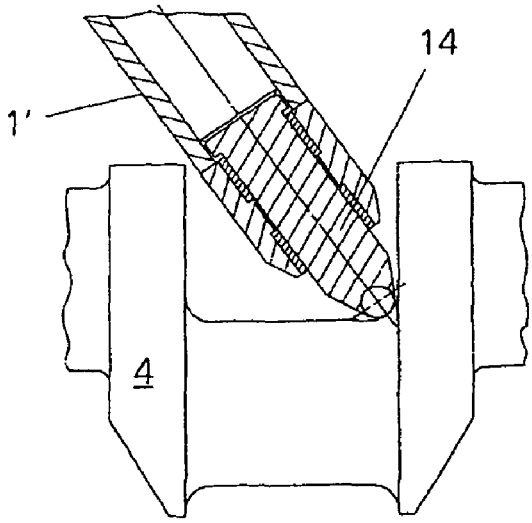
FIG. 6 shows a detail of a pulsed-pressure machine with only one striking tool.

FIG. 6 shows a pulsed-pressure machine 1' which is provided with only one striking tool 14. In this case, the pulsed-pressure machine 1' is positioned obliquely with respect to the crankshaft 4, to be precise in such a manner that the striking tool 14 which is arranged coaxially with respect to the longitudinal axis of the pulsed-pressure machine 1' strikes the area of the crankshaft segment to be processed, at right angles. In this case, although only one crankshaft segment is processed in each case, the design configuration and the force transmission of the pulsed-pressure machine 1' are on the other hand better and simpler for this purpose. In addition, this tool allows hole ends to be strengthened vertically.

This refinement has been found to be particularly advantageous for use with asymmetric crankshaft segments such as the end areas and the oil hole ends; however, it can also be used on further components, in particular on segments with which the intrinsic compressive stresses cannot be introduced symmetrically.

What is claimed is:

1. A method for increasing the fatigue life, in particular the bending fatigue life and the torsional fatigue life of crankshafts, in particular of large crankshafts, by local hammering of highly loaded areas, such as grooves, hole mouths and cross-sectional junctions, by means of pulsed-pressure machines or striking apparatuses which introduce intrinsic compressive stresses into the crankshaft via striking tools, characterized in that the pulsed-pressure apparatuses or striking machines carry out only a relative movement on a plane at right angles to the surface of the crankshaft segment at the time at which the compressive stress is introduced between the striking tool and the crankshaft segment to be processed, with the crankshaft being rotated continuously during the processing, and in that the time during which the striking tool is acting and the striking pressures are chosen such that, when the striking tool strikes the crankshaft segment to be processed while the intrinsic compressive stresses are being introduced, the rotational movement of the crankshaft is necessarily stopped.

2. The method as claimed in claim 1, characterized in that the striking frequency of the striking tool is between 0.1 and 20 Hz.

3. The method as claimed in claim 2, characterized in that the striking frequency of the striking tool is between 1 and 10 Hz.

4. The method as claimed in claim 3, characterized in that the striking frequency of the striking tool is between 3 and 6 Hz.

5. The method as claimed in claim 1, characterized in that the striking pressures of the striking tool are between 10 and 300 bar.

6. The method as claimed in claim 5, characterized in that the striking pressures of the striking tool are between 30 and 130 bar.

7. The method as claimed in claim 6, characterized in that the striking pressures of the striking tool are between 50 and 110 bar.

8. The method as claimed in one of claims 1 to 7, characterized in that the temperature in the region of the crankshaft segment to be processed is less than 65° C.

9. The method as claimed in claim 8, characterized in that the temperature in the region of the crankshaft segment to be processed is between 12 and 25° C.

10. The method as claimed in claim 1, characterized in that the intrinsic compressive stresses are introduced by means of the striking tools on crankshafts which have already previously been processed by a method for increasing the fatigue-life characteristics.

11. The method as claimed in claim 10, characterized in that the intrinsic compressive stresses are introduced by the striking tools after induction hardening of the crankshaft.

12. The method as claimed in claim 1, characterized in that, once the intrinsic compressive stresses have been introduced by the striking tools, the intrinsic compressive stresses close to the surface are reduced by machining away the surface of the crankshaft segment to be processed.

13. The method as claimed in claim 12, characterized in that up to 3 mm of the surface of the processed crankshaft segment is removed.

14. The method as claimed in claim 13, characterized in that between 0.3 and 2 mm of the surface of the processed crankshaft segment is removed.

15. The method as claimed in claim 12, characterized in that the removal is carried out by grinding, turning or milling.

16. The method as claimed in claim 1, characterized in that, in one refinement of the crankshaft segment to be processed, and which is in the form of a catenary, the continuous junction radii which are in the form of an initial contour are compressed by the introduction of the intrinsic compressive stresses via the striking tools, and the junction radii are then processed to the required final contour, as a catenary shape, by a method for removing material from the surface.

17. The method as claimed in claim 1, characterized in that, in one refinement of the crankshaft segment to be processed and in the form of a catenary, the striking tools are provided with the desired catenary shape.

18. The method as claimed in claim 17, characterized in that the catenary shape of a striking tool is formed on a plane which extends in the longitudinal direction of the crankshaft, while a spherical shape is formed on a plane at right angles to the longitudinal direction.

19. The method as claimed in claim 1, characterized in that the pulsed-pressure apparatuses or striking machines are each aligned with their longitudinal axes in the striking direction, and in that the intrinsic compressive stresses are introduced by in each case only one striking tool, which is arranged in the associated pulsed-pressure apparatus or striking machine.

* * * * *